United States Patent [19]

Shepley

[11] 4,185,374

[45] Jan. 29, 1980

[54] METHOD OF STRINGING A TWO WHEEL COMPOUND ARCHERY BOW

[76] Inventor: Paul E. Shepley, Rte. 1, Mahomet, Ill. 61853

[21] Appl. No.: 884,978

[22] Filed: Mar. 9, 1978

Related U.S. Application Data

[62] Division of Ser. No. 742,413, Nov. 17, 1976, Pat. No. 4,078,538.

[51] Int. Cl.[2] ..... F41B 5/00

[52] U.S. Cl. ..... 29/434; 124/90; 124/24 R

[58] Field of Search ..... 124/24 R, 86, 88, 90, 124/1, 80, 41 A, 23 R

[56] References Cited

U.S. PATENT DOCUMENTS

| | | | |
|---|---|---|---|
| 3,854,467 | 12/1974 | Hofmeister | 124/90 X |
| 4,054,118 | 10/1977 | McKee et al. | 124/90 X |
| 4,060,066 | 11/1977 | Kudlacek | 124/90 X |
| 4,079,723 | 3/1978 | Darlington | 124/24 R |

*Primary Examiner*—Richard C. Pinkham
*Assistant Examiner*—William R. Browne
*Attorney, Agent, or Firm*—Jack E. Dominik

[57] ABSTRACT

A method of stringing a compound archery bow. A preswedged off-end of a first cable is mounted to a mount on a first pulley. The first cable is then extended to a second pulley, wrapped in a grooved section of a central circumferential surface of the second pulley, strung in a slot on one sidewall of the second pulley, and passed through a central aperture of the second pulley until a mount chip is directly adjacent a stepped section of another slot on the other sidewall of the second pulley. The cable is then strung into a slot on the other side and the mount chip is inserted into the stepped section. The remaining length of the cable is wrapped in another grooved section of the central circumferential surface of the second pulley and the end of the first cable is then attached to the bow string. A second cable is then strung by following the steps of the method for stringing the first cable in reverse order.

5 Claims, 7 Drawing Figures

FIG. 1
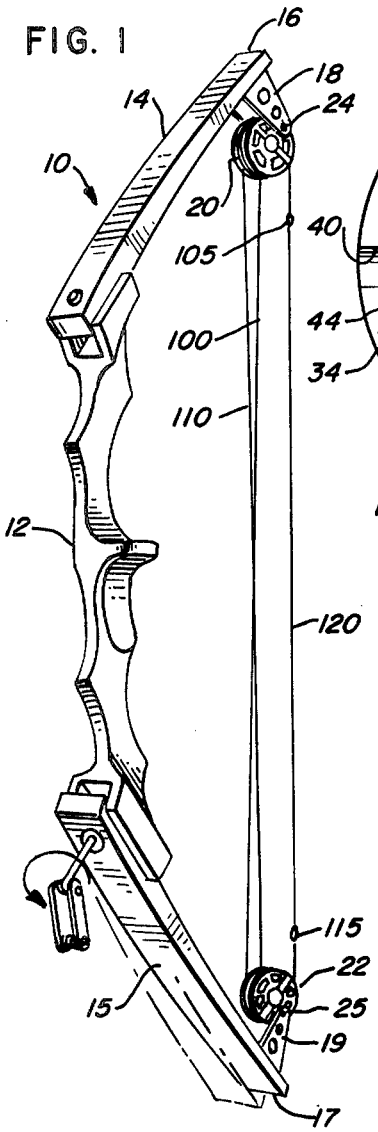
FIG. 2
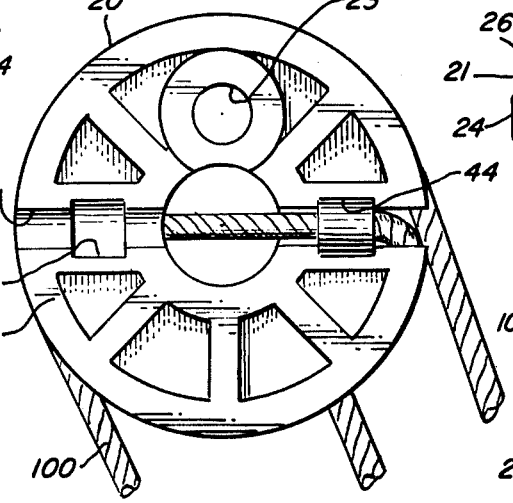
FIG. 3
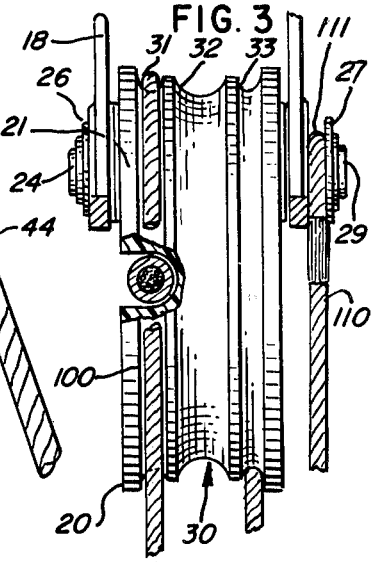
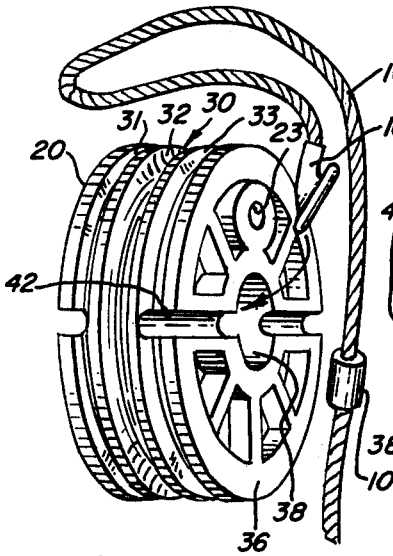
FIG. 4
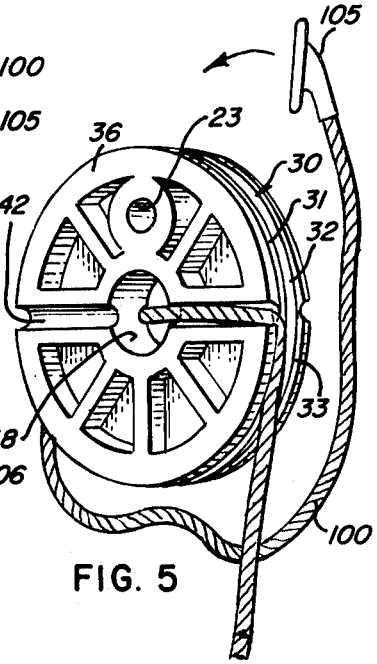
FIG. 5
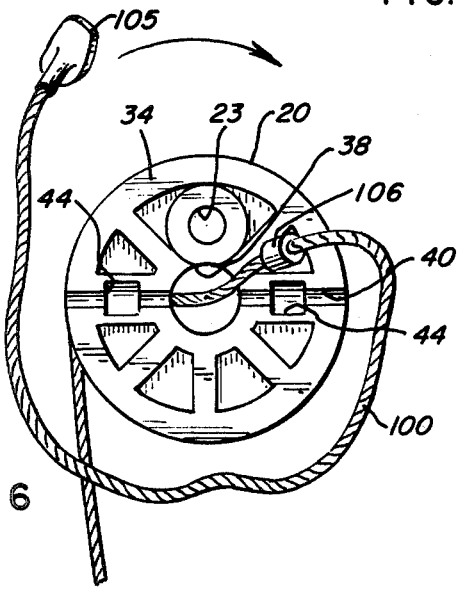
FIG. 6
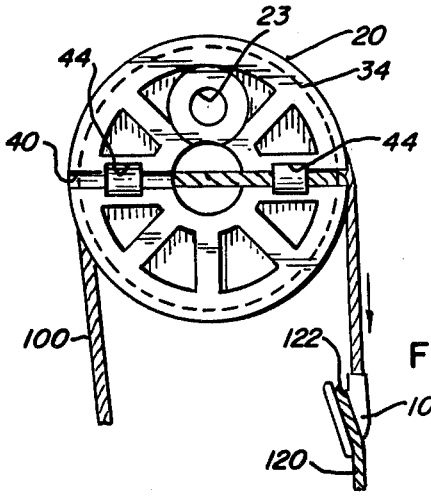
FIG. 7

METHOD OF STRINGING A TWO WHEEL COMPOUND ARCHERY BOW

This is a division, of application Ser. No. 742,413 filed Nov. 17, 1976 now U.S. Pat. No. 4,078,538.

BACKGROUND OF THE INVENTION

Various types and constructions of compound archery bows have been developed over the last several years. Generally, such archery bows are provided with a central handle section to which are joined a pair of outwardly extending bow limbs, and at the end of each of the bow limbs is provided a pulley mounted eccentrically to the tip of the bow limb. The opposed pulleys at the opposed ends of the bow limbs are designed to carry a cable system therebetween, a cable system in turn carrying a stretch of a bow string along the central stretch of the bow. The eccentrically mounted pulleys are designed to accentuate and compound the flexing of the bow limbs bearing the initial as well as the final pull of the bow, which in turn has an impact and an effect on the velocity of the arrow as the same leaves the bow.

In some of the compound archery bows heretofore developed, a series of four wheels are mounted on the archery bow. In such constructions, in addition to the two eccentrically mounted pulleys at the tips of the bow limbs, there is also provided two idler wheels which are carried on the bow limbs adjacent to the positioning of the central handle section. In such constructions, it is intended that the cable system not only be wrapped about the eccentric pulleys, but also be wrapped about the idler wheels and mounted at a point spaced somewhat inwardly from the bow limbs and it has been found that this type of construction further compounds the flexing of the bows and hence has an even further impact upon the velocity of the arrow as it leaves the bow. In other constructions, the compound effect is obtained by only two eccentric pulleys mounted at the tips of the bow limbs. Such types of compound archery bows are generally referred to as "two wheelers" since they only are provided with the two eccentric pulleys. While a two wheeler system is somewhat less efficient than a full four wheel network of the type mentioned hereinabove, there are distinct advantages in that the two wheel approach is basically simpler in construction, puts less strain on the bow limbs during the pull of the bow and the release thereof, and requires very little periodic tuning, and has a built in feed back system which insures that the eccentric wheels will always remain in balance, that is, the eccentric wheels or pulleys will roll over the eccentric mounting thereof at the same point as the bow is drawn. It is apparent to those skilled in the art that where the eccentric pulleys are not properly tuned, and where one pulley turns over the eccentric axis at a point in time different than the other pulley as the bow string is being drawn, the two pulleys will be out of balance and this has a direct impact upon the accuracy and velocity of the arrow as it leaves the bow. Hence, the provision of a two wheel compound archery bow has been prevalent in the art.

As with any compound archery bow, perhaps the most crucial part of the bow relates to the cable system. The cable system is designed to be carried between the two eccentric pulleys and designed to further carry the bow string therebetween. It is therefore the cables which are part of the system which exerts the force on the bow limbs flexing the bow limbs when the bow is drawn. In addition, that portion of the cable which wraps around each of the individual eccentric pulley wheels and joins the bow string at its opposed ends is generally referred to as the "tune length" and, in fact, determines when the eccentric wheels will roll over the eccentric axis thereby to provide the compound effect. In view of the fact that the cable system is subject to wear with use, they must be changed periodically and generally, this ranges at intervals of anywhere from two weeks to a year. Hence, the system by which the cables are strung on the bow is important since it is necessary to frequently replace the cable system and hence, one of the essential features of such a compound bow is to provide a cable system which permits ease of replacement.

Traditionally, the off-end of the cable, that being the end opposite that which is attached to the bow string, has been connected to an eye hook by means of a loop swedged at the cable end. The loop is usually attached to an eye hook on a turnbuckle which thereby makes it possible to adjust the effective length of the cable. This in turn makes it possible to adjust the eccentric wheel balance. The problems which have existed with this system are manyfold. Firstly, the cable must be threaded through a narrow shaft drilled through the long or flat axis of the eccentric pulley wheel and locked into place by tightening down on a hex screw, and then the cable is wrapped around the eccentric pulley to attach to the bow string. As indicated previously, the length of cable which protrudes from and is then wrapped around the eccentric pulley wheel is referred to as the tune length and is very critical since it has a direct effect on the "compound effect" achieved by the bow. It is, therefore, important that the tune length be properly determined so that the bow is properly in tune. In connection with the presently available two wheel systems, the replacement of cables in a manner to achieve a proper tune length has been difficult because it requires the bending of the springy cables at the proper location in order to wrap the same around the pulley wheels, insuring that the hex nut is screwed tight enough to lock the cables in place on the pulley wheels but not so tight as to strip the threads, and finally, it is necessary to then swedge the end of the cable in order to secure the same to the bow. In the past, in order to effect a swedging process, it is necessary to have a fairly large and expensive hand swedging tool. Generally, users of such compound bows must, therefore, take the bows to a dealer or other location where such a swedging tool is located so that the cable system may be strung in order to permit the off-end of the cable to be swedged. As has been indicated above, the two wheeler compound archery bows presently available have been unable to provide users thereof with precut, preswedged cables for replacement due to the problems mentioned above.

OBJECTS AND ADVANTAGES

The present invention seeks to resolve the difficulties mentioned above by providing certain improved changes to the two wheeler system incorporated on two wheel compound archery bows such as to permit precut and preswedged cable systems to be employed by the users thereby to permit the users of the compound archery bows to replace the cable system without the need of any hand swedging tool.

It is, therefore, the principal object of the invention to provide a method of stringing an improved compound archery bow of the two wheeler type wherein the pulley system has been improved by providing a pivot pin for pivotally mounting each pulley to the outer end of the corresponding bow limb through an eccentric axis of the pulley where each of the pivot pins includes a lateral extension portion extending laterally outwardly for a short distance beyond the corresponding pulley, and wherein each of the pulleys is defined by a central circumferential surface bounded by opposed side walls and having at least one groove provided in the central circumferential surface and including an aperture centrally disposed through the pulley and extending through the opposed side walls, the central aperture being sized to accommodate the passage therethrough of a preswedged off-end of the cable, each of the opposed side walls of the pulley further being slotted across the diametrical axis thereof, and a pair of cables for mounting on the bow, each of the cables having an off-end and a bow string end with the off-end being preswedged, and wherein the lateral extension portion of each of the pivot pins is adapted to carry the preswedged off-end of the corresponding cable.

In connection with the foregoing object, it is yet a further object of the invention to provide a method of stringing an improved compound archery bow of the type described wherein each of the corresponding cables is provided with mounting means, the mounting means being securely affixed to the corresponding cable at a predetermined location and sized for insertion in the slot provided in the corresponding side walls of the eccentric pulleys thereby to securely hold the corresponding cable in position on the bow.

Still a further object of the invention is to provide a method of stringing an improved compound bow of the type described wherein the bow string end further includes a bow string attachment fixture fixedly secured to the cable, the bow string attachment fixture being prestrung on the cable and provided to the ultimate user as a finished product.

In connection with the foregoing objects, it is yet a further object of the invention to provide a method of stringing an improved compound archery bow of the type described wherein at least one of the slots in one of the side walls of each of the pulleys includes an enlarged stepped section and the mount means associated with each of the cables comprises a mount clip fixedly secured to the cable, the mount clip being sized for insertion in the stepped section of the corresponding slot thereby to securely hold the corresponding cable in position on the bow as well as to predetermine for the user the precise location and size of the portion of the cable to be wrapped around the corresponding pulley to terminate in a bow string end of the cable.

The invention, will best be understood by reference to the following specification taken in connection with the accompanying drawings as defined herein below.

BRIEF DESCRIPTION OF DRAWINGS

FIG. 1 is a perspective view of a compound bow of the type including two eccentric pulleys mounted on the tip ends of the bow limbs in accordance with the present invention;

FIG. 2 is a side elevational view showing one of the pulleys and the manner in which the corresponding cable is strung thereon;

FIG. 3 is a front elevational view of one of the pulleys, again showing the manner in which the cable system is strung thereon;

FIG. 4 is the first of four sequential views, in perspective, showing the manner in which the cable is commenced to be strung thereabout;

FIG. 5 is the second of four sequential views, again in perspective, showing the sequential stringing of the cable thereabout;

FIG. 6 is the third in the sequential views, in side elevational view showing cable partially strung on the pulley and the mount clip ready for insertion in the stepped section of the slotted portion of the pulley; and FIG. 7 is a final view of the for view sequence, in side elevational view, showing the cable finally strung about the pulley and having the one end of the bow string attached on the bow attachment fixture.

BRIEF SUMMARY OF INVENTION

Briefly described, the present invention provides an improved pulley and cable system for use in connection with a compound archery bow of the two wheeler variety wherein the eccentric pulleys are each constructed and formed by a central circumferential surface bounded by a pair of opposed side walls, and having a central aperture disposed therethrough and extending through the side walls, and wherein each of the side walls is provided with a slot extending across the diametric axis of the pulley, and wherein the cable system which is provided includes a preswedged off-end as well as a preformed bow string attachment fixture at the opposed end, each of the cables being precut to a predetermined length such that the cables may be strung across the pulley system without the need of any extraneous hand tools or other implements. Concomitantly, the invention provides an improved cable system and pulley arrangement whereby the compound archery bow and the cable system associated therewith is constructed such that upon replacement of the cable system on the bow, the cable system and associated pulleys will be pretuned such that the compound archery bow will remain in tune even upon replacement of the cable system. The improvement set forth herein will be better understood by reference to a detailed description of the drawings set forth hereinbelow.

DETAILED DESCRIPTION OF DRAWINGS

As generally depicted in FIG. 1 of the drawings, the present invention has reference to a compound archery bow of the two wheeler variety, generally referred to by the numeral 10. The archery bow 10 is shown to be formed by a central handle section 12, to which are joined bow limb sections 14 and 15 respectively. Each of the bow limb sections 14 and 15 terminate at a bow tip end 16 and 17 respectively where an eccentric pulley attachment fixture 18 and 19 respectively are mounted.

As shown in FIGS. 1 and 3 of the drawings, a first eccentric pulley 20 is mounted to the attachment fixture 18 along an eccentric axis of the pulley, generally represented by the numeral 21 (FIG. 3). As will be observed in FIG. 1 of the drawings, a second eccentric pulley 22 is similarly mounted on the attachment fixture 19, again along an eccentric axis of the pulley 22. The eccentric mounting of each of the pulleys 20 and 22 is accomplished by means of a pivot pin 24 and 25 respectively, and as shown in FIG. 3 of the drawings, the pivot pin 24 is fixedly held in position by means of lock washers 26 and 27 respectively. As is further shown in FIG. 3, the pivot pin 24 (as well as the pivot pin 25) includes a laterally outwardly extension portion 29 which is shown to extend laterally outwardly beyond the pulley 20. In the following description reference will be made to the construction of pulley 24 and a mounting thereof to attachment fixture 18 but it will be understood that the identical construction and mounting applies to pulley 22 and the mounting thereof to attachment fixture 19. For sake of convenience and description, however, reference will be made only to the construction and mounting of pulley 20 and the structural features thereof.

The pulley 20 is shown to be formed by a central circumferential surface generally referred to by the numeral 30, provided with a series of three grooved portions 31, 32, and 33, respectively. The eccentric pulley 20 is shown to be bounded by a pair of opposed side walls 34 and 36, respectively, and includes a central aperture 38 disposed through the pulley 20 and traversing the side walls 34 and 36. In addition, from a view of FIGS. 2 and 4 through 7 of the drawings, it will be observed that each of the side walls 34 and 36 are provided with slots 40 and 42, respectively. The slots 40 and 42 are shown to extend across the diametrical axis of the pulley 20 and are sized to accommodate the insertion therein of a corresponding cable generally represented by the numeral 100. The slot 42 provided in the side walls 36 is shown to be formed as a generally laterally extending uniform sized slot whereas the slot 40 provided in side wall 34 is shown to further include a stepped section 44 adjacent each of the diametric sides on opposite sides of the central aperture 38.

The construction of the eccentric pulley 20 is completed by a pivot pin bounding aperture 23 which accommodates the insertion therethrough of the pivot pin 24 thereby to pivotally secure the eccentric pulley 20 in position on the eccentric pulley attachment fixture 18, all in the manner shown in FIG. 3 of the drawings.

It will also be appreciated that the cable system associated with the bow is provided by means of two cables, cable 100 as shown in the drawings, and cable 110 (FIG. 1). The construction of cables 100 and 110 are identical, and for ease of description, reference will be made to the construction and the mounting of cable 100 on pulley 20. It will be understood, however, that the identical construction and mounting is applicable with respect to cable 110 on pulley 22 with the exception that cable 110 terminates at the opposed end of the bow in order to accommodate a bow string 120 to be strung therebetween.

As shown in FIGS. 1 and 3 of the drawings, cable 110 terminates at its one end in a looped or pre swedged off-end 111 which is adapted for mounting and positioning on the pivot pin 24 along the lateral extension portion 29 thereof. The cable 110 then is strung downwardly to be wrapped about eccentric pulley 22 in a manner which will be described in connection with cable 100 and the manner of mounting the same about eccentric pulley 20. The off end of cable 100 is not precisely shown in the drawings, however, it is to be understood that cable 100 similarly terminates in a off end which is looped or swedged as was described in connection with ends 111 of cable 110 and is designed for being mounted on the lateral extension portion of pivot pin 25. This is generally shown in FIG. 1 of the drawings.

The preswedged off-end of the cable 100 is therefore carried on the lateral extension portion of pivot pin 25 in the same manner as depicted in connection with cable 110 and the manner of its being mounted on pivot pin 24 (FIG. 3), and cable 100 is then strung across the bow upwardly toward eccentric pulley 20. As shown in various figures in the drawings, cable 100 terminates at its opposed end in a fixedly secured bowstring attachment fixture 105. In addition, cable 100 is further provided with a mount clip 106 which is constructed and sized to be postionally inserted in the stepped section 44 of the slot 40 positioned in the side wall 34 of pulley 20. The manner of stringing cable 100 about pulley 20 will now be evident.

As shown in FIGS. 4 through of the drawings, taken in conjunction with FIG. 1, the preswedged off-end of cable 100 is mounted on the lateral extension portion of the pivot pin 25 which carries pulley 22 on the bow 10. The cable is then strung upwardly toward pulley 20 and is inserted through the slot 42 provided in the side wall 36. The cable end is then passed through the central aperture 38 of pulley 20 until the mount clip 106 positioned on the cable 100 is directly adjacent to the stepped section 44 of slot 40 positioned in the opposed side wall 34. The mount clip 106 is then positionally inserted in the stepped section 44 which thereby predetermines the remaining length of the cable 100 to be strung about the eccentric pulley in the grooved section 31 as shown in FIG. 3 of the drawings. The cable 100 with the bowstring attachment fixture 105 positioned at the end thereof is wrapped one turn about the pulley 20 in grooved section 31 thereof and extends downwardly to a terminal point generally represented in FIG. 7 of the drawings. As shown therein, the bowstring attachment fixture 105 is constructed to carry one end of a bowstring 120 which is simply formed as a central stretch of the bowstring having preswedged or looped ends generally represented by the numeral 122.

In view of the fact that cable 110 is strung similarly between the lateral extension portion 29 of pivot pin 24 and is then strung about eccentric pulley 22 in the same manner, and in further view of the fact that cable 110 similarly terminates at its opposed end in a bowstring attachment fixture 115 (FIG. 1) a bowstring 120 may be strung between the respective bowstring attachment fixtures 105 and 115 to complete the assembly. It will further be appreciated that since each of the cables 100 and 110 is provided with a similar mount clip 106 which is designed for positionally insertion within the stepped section 44 of the slot 40, and since this construction is duplicated in the opposed pulley 22, the terminal length of the cable extending from the pulley 20 and 22 to the respective bowstring attachment fixture 105 will be predetermined during the manufacturing process. Hence, upon replacement of the entire cable system on a bow 10, the user will be assured of the fact that the cable system will balance the eccentric pulleys 20 and 22 such that the tune length of the cables will be identical and that the pulleys will be synchronized and in tune.

It will further be appreciated that by constructing the central aperture 38 of the pulley 20 and the central aperture of the pulley 22 in a manner described herein, the cables may be preswedged at the point of manufacture and the user need not be concerned with having to swedge the cable after fishing the cable through any slots or apertures in the corresponding pulleys. The provision of the slots in the side walls of the pulley as well as the stepped section as described above further insures that once the cable is strung on the pulley and the mount clips inserted in position, that the tune length of each of the cables will be predetermined and keep the bow in tune.

It will be appreciated from the above description that the present invention has provided an improved cable and pulley system for use in connection with a compound archery bow, generally of the two wheeler construction, which permits ease of replacement of the cable system while at the same time insuring that the cable system will be pre-tuned such that upon placement and the stringing on the bow, the tuning of the eccentric pulleys, and hence, the roll-over of the two pulleys will be identical in order to insure that the bow in its entirety will remain in tune. In addition, the present invention provides a relatively simple construction for the cable system and relative simplicity in terms of ease of replacement of the cable system on the bow. It will further be appreciated that by providing a cable system and pulley arrangement of the type described, pre-cut and predetermined cables may now be manufactured and sold for the ultimate consumer which eliminates the need for any types of hand tools heretofore required to effect a replacement of the cable system on the bow.

While there has been described what is a present considered to be the preferred embodiment of the invention, it will be understood that various modifications may be made therein without departing from the true spirit and scope thereof, and as defined in the accompanying claims.

What is claimed is:

1. A method of stringing a compound archery bow, comprising the steps of:

- joining a first and a second bow limb to a centrally positioned handle section,
- pivotally mounting one of each of a first and a second pulley on the outer end of a corresponding bow limb through an eccentric axis of the pulley,
- providing a first and a second cable for holding a bow string in a tensioned condition along a central stretch of the bow,
- mounting a preswedged off-end of the first cable on a first pin for supporting the first pulley,
- extending the first cable to the second pulley,
- wrapping the first cable in a grooved section of a central circumferential surface of the second pulley and stringing the first cable in a slot on one side wall of the second pulley and passing the end of the first cable through a central aperture of the second pulley until a mount chip is directly adjacent a stepped section of another slot positioned on the other side wall of the second pulley,
- stringing the cable into the slot of the other side and inserting the mount chip into the stepped section,
- wrapping the remaining length of cable which is predetermined by the positioning of the mount chip along the cable in another grooved section of the central circumferential surface of the second pulley and attaching the end of the first cable to the bow string.

2. The method of claim 1,

- repeating all the above steps for the second cable in reverse order by starting with mounting a preswedged off-end of the second cable to a lateral extension portion of a second pin carried by the outer end of the second bow limb adjacent said second pulley.

3. The method of claim 1,

- the step of wrapping the cable around another groove and attaching the end of the first cable to the bow string further including wrapping the cable for one turn about the second pulley prior to extending the same to be attached to a bow string.

4. In the method of claim 1,

- the additional step of mounting a preswedged off-end of the first cable to a lateral extension portion of the first pin mounting the first pulley.

5. In the method of claim 1,

- the additional step of mounting a preswedged off-end of the first cable to an extension portion of the first pin which is the axle of the first pulley.

* * * * *